US010208941B2

(12) United States Patent
De Graaf et al.

(10) Patent No.: US 10,208,941 B2
(45) Date of Patent: Feb. 19, 2019

(54) LAMP COMPRISING COOLING MEANS

(71) Applicant: PHILIPS LIGHTING HOLDING B.V., Eindhoven (NL)

(72) Inventors: Jan De Graaf, Eindhoven (NL); Edwin De Groot, Eindhoven (NL); Simon Jacobus Maria Kuppens, Eindhoven (NL); Simon Eme Kadijk, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/774,647

(22) PCT Filed: Nov. 18, 2016

(86) PCT No.: PCT/EP2016/078121

§ 371 (c)(1),
(2) Date: May 9, 2018

(87) PCT Pub. No.: WO2017/085244

PCT Pub. Date: May 26, 2017

(65) Prior Publication Data

US 2018/0245784 A1 Aug. 30, 2018

(30) Foreign Application Priority Data

Nov. 19, 2015 (EP) ..... 15195377

(51) Int. Cl.
*F21K 9/23* (2016.01)
*F21V 29/51* (2015.01)
(Continued)

(52) U.S. Cl.
CPC ..... *F21V 29/51* (2015.01); *F21K 9/23* (2016.08); *F21V 3/02* (2013.01); *F21V 29/503* (2015.01);
(Continued)

(58) Field of Classification Search
CPC ..... F21V 29/51; F21V 29/507; F21V 29/503; F21V 29/506; F21V 29/00; F21V 29/06;
(Continued)

(56) References Cited

U.S. PATENT DOCUMENTS 8,558,436 B2 * 10/2013 Horn ..... F21V 29/004 313/11
8,860,288 B2 10/2014 Chang et al.
(Continued)

FOREIGN PATENT DOCUMENTS

KR 2012086914 A 8/2012
WO WO2011097486 A2 8/2011
WO WO2013060357 A1 5/2013

*Primary Examiner* — Joseph L Williams
*Assistant Examiner* — Jose M Diaz
(74) *Attorney, Agent, or Firm* — Akarsh P. Belagodu

(57) ABSTRACT

According to the invention a lamp (100, 200) is provided. The lamp (100, 200) comprising: a wick structure (102, 202) hosting a solid state light source (104, 204) and comprising a fixed wick material (108, 208), an envelope (106, 206) forming a cavity (109, 209) hosting the wick structure (102, 202), wherein the cavity (109, 209) is configured as a heat pipe comprising a working fluid (110, 210), wherein the envelope (106, 206) is shaped such that condensed working fluid (110, 210) is guided towards the fixed wick material (108, 208) independently of the spatial orientation of the lamp (100, 200).

7 Claims, 2 Drawing Sheets

(51) Int. Cl.

| | |
|---|---|
| ***F21V 3/02*** | (2006.01) |
| ***F21V 29/506*** | (2015.01) |
| ***F21V 29/503*** | (2015.01) |
| ***F21V 29/507*** | (2015.01) |
| *F21Y 115/30* | (2016.01) |
| *F21Y 115/10* | (2016.01) |

(52) U.S. Cl.
CPC ..... *F21V 29/506* (2015.01); *F21V 29/507* (2015.01); *F21Y 2115/10* (2016.08); *F21Y 2115/30* (2016.08)

(58) Field of Classification Search
CPC ... F21V 29/56; F21V 3/02; F21K 9/23; F21K 9/13; F21Y 2115/10; F21Y 2115/30; F21S 45/40; H01J 7/26; H05K 7/208; H01B 7/423
See application file for complete search history.

(56) References Cited

U.S. PATENT DOCUMENTS

| | | | | |
|---|---|---|---|---|
| 9,057,514 | B2 * | 6/2015 | Sills | F21V 29/51 |
| 9,435,524 | B2 * | 9/2016 | Athalye | F21V 29/59 |
| 2006/0001384 | A1 * | 1/2006 | Tain | F21K 9/00 315/246 |
| 2011/0074296 | A1 | 3/2011 | Shen et al. | |
| 2011/0193479 | A1 | 8/2011 | Nilssen et al. | |
| 2013/0170175 | A1 | 7/2013 | Negley et al. | |

* cited by examiner

LAMP COMPRISING COOLING MEANS

CROSS-REFERENCE TO PRIOR APPLICATIONS

This application is the U.S. National Phase application under 35 U.S.C. § 371 of International Application No. PCT/EP2016/078121, filed on Nov. 18, 2016, which claims the benefit of European Patent Application No. 15195377.5, filed on Nov. 19, 2015. These applications are hereby incorporated by reference herein.

FIELD OF THE INVENTION

The invention relates to a lamp.

BACKGROUND OF THE INVENTION

The development in the field of solid state light sources, SSLs, has made it practicable and economical to replace traditional light sources, such as incandescent light lamps or fluorescent lamps, with SSLs based lamps for both indoor and outdoor lighting. Given their favorable energy efficiency and long lifespan, SSLs lamps are often considered more environmentally friendly than their traditional counter parts.

Today, SSLs lamps are available in various designs. Moreover, it is desirable to be able to orient SSL lamps in all possible orientations in space.

SSL lamps are less than 100% efficient. The heat that is generated during operation generally leads to temperatures that may deteriorate the system efficacy and may limit the lifetime of the SSLs and other components of the SSL lamps. Hence, heat from the SSLs of the SSL lamps need to be transferred away from the SSLs. One conventional way to do this is to use heat sinks. Another possibility is to form the SSL lamp as a heat pipe comprising a working fluid used for transferring heat from the SSLs. However, since it is desirable to be able to orient SSL lamps in any orientation in space great demands are put on the design of the heat pipe such that the working fluid may efficiently transfer heat away from the SSLs of the SSL lamp. Hence, there is a need for novel deigns of lamps comprising SSLs.

SUMMARY OF THE INVENTION

It is an object of the present invention to overcome at least some of the above problems, and to provide a lamp with improved light output, which may be efficiently operated independent on its orientation in space.

According to a first aspect of the invention, this and other objects are achieved by providing a lamp. The lamp comprising: a wick structure hosting a solid state light source and comprising a fixed wick material, an envelope forming a cavity hosting the wick structure, wherein the cavity is configured as a heat pipe comprising a working fluid, wherein the envelope is shaped such that condensed working fluid is guided towards the fixed wick material independently of the spatial orientation of the lamp.

A lamp providing efficient heat management is thereby provided. The working fluid may be in a liquid and/or vapor phase. Hence, the wick structure allows for transport of working fluid in the liquid phase, by capillary forces, towards the solid state light source, SSL. During or after operation of the SSL, a portion of the working fluid may be evaporated by heat originating from the SSL, whereby the evaporated working fluid, i.e. in a vapour phase, may leave the wick structure and condense at the surface of the envelope. The shape of the envelope further allows the condensed working fluid to be guided towards the fixed wick material. An efficient recycling of the working fluid is thereby provided. As a consequence, the amount of working fluid which cools the SSL may be increased. An improved thermal management of the lamp is thereby provided, which allows for efficient cooling of the SSL. The lifetime and efficiency of the SSL may further be increased. The shape of the envelope also reduces constraints on the spatial orientation of the lamp when in used. A more versatile lamp is thereby provided which offers increased durability and light output.

The wording "wick structure" should be construed as a structure allowing for transport of a fluid from a condenser to an evaporator, i.e. from the envelope to the SSL. Capillary forces in the fixed wick material of the wick structure drive the fluid transport. The shape of the wick structure is, moreover, substantially unchanged as a result of a change in the orientation of the lamp. More specifically, the fixed wick material of the wick structure is arranged to be fixed in relation to the envelope. The wick structure further facilitates the heat pipe function by mass transport as well as heat transfer.

The wording "heat pipe" should be construed as heat-transfer device which may combine the principles of thermal conductivity and phase transition to efficiently manage the transfer of heat between two interfaces. In other words, the heat pipe is formed by the cavity of the envelope hosting the wick structure. The evaporator, the condenser and the working fluid provide the heat-transfer. The heat transfer takes place by continues cycling of evaporation and condensation of the working fluid, driven by the heat generation from the evaporator, i.e., the heat being given off by a condensation process at the condenser.

The envelope may be convex as seen from an inside of the lamp. This is advantageous as working fluid which is present at the envelope may be transported by gravitational forces to the fixed wick material independently on the orientation of the lamp in space. In other words, the shape of the envelope enables, at least, the lamp to be operated in base-up or base-down direction as well as in the horizontal directions. Efficient cycling of the working fluid may thereby be achieved independently on the orientation of the lamp. An improved cooling of the SSL may moreover be achieved by this design of the envelope.

The wording "the envelope is convex" should be understood as the envelope comprising a portion which has a convex shape as seen from the interior of the lamp.

The envelope may further comprise an outer surface which is arched in as seen from an outside of the lamp. More specifically, a portion of the envelope, which is rounded inward, may have neighboring surface normal, pointing way from the interior of the envelope, which converge in space. The volume spanned by the envelope may further be reduced leading to a more compact lamp.

The envelope may be hourglass-shaped or saddle-shaped.

The fixed wick material may be dumbbell-shaped. The fixed wick material may thereby be efficiently arranged to be in fluid connection with portions of the envelope at which working fluid, condensed at the envelope, is transported by gravitational forces, independently on the orientation of the lamp in space. The fixed wick material may thereby be in physical contact with reservoirs of working fluid formed at or near by distal ends of the envelope.

The wick structure may further comprise a support. An improved rigidity of the fixed wick material may thereby be provided. The shape of the fixed wick material may moreover be formed by the support. The support may additionally act as a heat sink.

The fixed wick material may be adapted to transport working fluid to the solid state light source, at least upon the solid state light source is in an active state emitting light. The fixed wick material may host the solid state light source. Hence, the SSL may be arranged inside or at the surface of the fixed wick material. Efficient heat transport between the fixed wick material and the solid light source is thereby provided.

At least a portion of the wick structure may be formed by a first material surrounded by a second material. Hence, one of the materials may support and/or fix the other material in relation to the envelope.

It is noted that the invention relates to all possible combinations of features recited in the claims.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a," "an," "the," and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

This and other aspects of the present invention will now be described in more detail, with reference to the appended drawings showing embodiment(s) of the invention. The figures should not be considered limiting the invention to the specific embodiment; instead they are used for explaining and understanding the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1C:
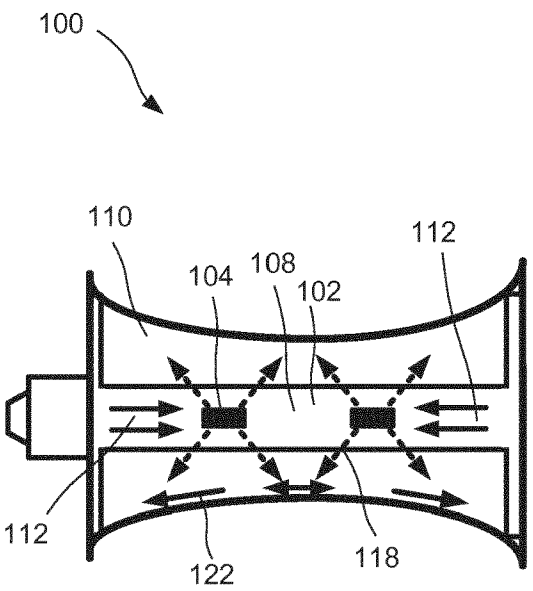
FIGS. 1*a*-1*c* illustrate cross-sectional side views of a lamp according to one embodiment of the present inventions, having different orientations in space.
Figure 1B:
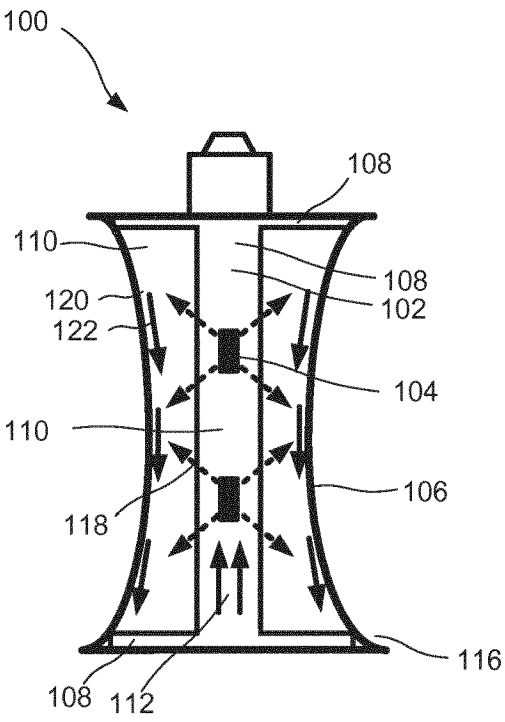
Figure 1A:
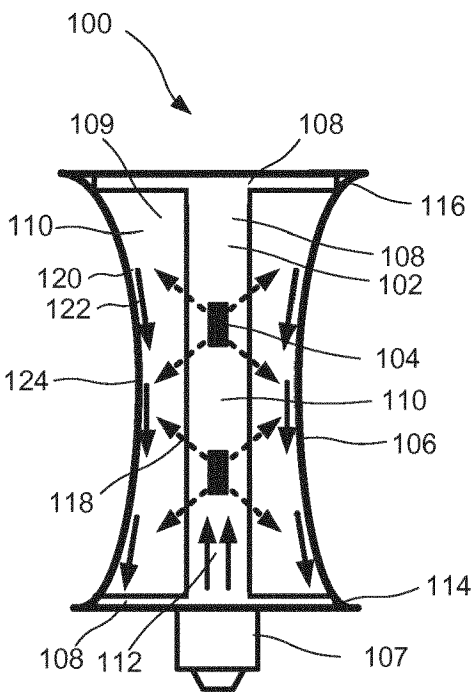

The FIGS. 1*a*-1*c* illustrate the same lamp, oriented differently in space, i.e. base-down, base-up, or horizontal. The lamp 100 comprises a wick structure 102, solid state light sources, SSLs, 104, and an envelope 106. The lamp 100 is further provided with a base 107 which may be treaded such that it may be screwed into a socket (i.e. an Edison screw fitting). The person skilled in the art realizes that the base may be of different forms. The base 107 may, moreover, comprise driver electronics for powering the SSLs 104 of the lamp 100. The base 107 may additionally comprise a heat sink for cooling the driver electronics.

The wick structure 102 comprises a fixed wick material 108 hosting the SSLs 104. The SSLs 104 may for example be light emitting diodes or laser diodes. The materials forming the SSLs may be organic and/or in-organic. For clarity, only two SSLs are illustrated. The person skilled in the art, however, realizes that the lamp 100 may alternatively comprise one SSL or more that two SSLs.

The envelope 106 forms a cavity 109. The cavity 109 is configured as a heat pipe comprising a working fluid 110 as will be discussed in the following. The wick structure 108 allows for transport 112 of working fluid 110, by capillary forces, towards the SSLs 104. It should be noted, that in the embodiment shown in FIGS. 1*a*-1*c*, the wick structure 102 is formed by the fixed wick material 108. The fixed wick material 108 is further dumbbell-shaped in order to have a large surface area and to reach the distal ends 114 and 116 of the envelope 106. This allows for an improved recycling of working fluid 110. The fixed wick material 108 may be formed as a single unit, as illustrated in the FIGS. 1*a*-1*c*, or comprise a plurality of units.

Next, the heat management of the SSLs 104 of the lamp 100 will be described in terms of a cooling of the SSLs 104. In operation or after operation of the lamp 100, the SSLs 104 may have an increased temperature. The increased temperature of the SSLs 104 may reduce their efficiency to produce light and the light output from the lamp 100 may therefore be reduced. Cooling of the SSLs 104, may, however, be achieved by efficiently passing the working fluid 110, as a coolant, by the SSLs 104, which are hosted in the wick structure 102. More specifically, a portion of the working fluid 110 which is transported 112 by the fixed wick material 108, to the SSLs 104 may cool the SSLs by means of a phase change, i.e. by the working fluid 110 being evaporated. The working fluid 110 which is evaporated after being in thermal contact with the hot SSLs 104 may thereafter leave the fixed wick material 108 as indicated be the dashed arrows 118.

The evaporated working fluid 110 may condensate 120 when reaching the surface of the envelope 106. Gravitational forces then transport the condensed working fluid 110 as indicated by the solid arrows 122 to the distal end 114 of the envelope 106. Working fluid 110 reaching the fixed wick material 108 at the bottom of the envelope 106 may then be reabsorbed by the fixed wick material 108. As a result the working fluid 108 may recycled within the lamp 100 such that it again may be used to cool the SSLs 104. In other words, the cavity 109 of the envelope 106 is configured as a heat pipe in which the fixed wick material 108 assists the heat pipe function by mass transport as well as heat transfer. Efficient heat management is thereby provided within the lamp 100.

The envelope 106 is hollowed inward 124 as seen from an outside of the lamp 100. This is advantageous as working fluid 110 which is condensed at the envelope 106 is transported by gravitational forces to the fixed wick material 108, independently on the orientation of the lamp 100. Thus, the envelope 106 is shaped such that condensed working fluid 110 is guided towards the fixed wick material 108 independently of the spatial orientation of the lamp 100. The formation of reservoirs of condensed working fluid 110 not reaching the fixed wick material 108 is thereby mitigated. Efficient cycling of the working fluid 110 may thereby be achieved independently on the orientation of the lamp 100. This is illustrated in FIG. 1*b* and FIG. 1*c*. FIGS. 1*b* and 1*c* illustrate the operation of the lamp 100 in base-up and horizontal position. It should be noted that the design of the lamp 100 allows also for efficient cooling of the lamp 100 when operated at other orientations in space than disclosed in FIG. 1*a*-1*c*. The lamp 100 may, for example, be oriented 45 degrees with respect to the base-down orientation.

In FIG. 1*b*, the lamp 100 the condensed working fluid 110 may reach the fixed wick material 108 in the distal end 116 of the envelope 106. In FIG. 1*c* the condensed working fluid 110 may reach the fixed wick material 108 in the distal end 114 or the distal end 116 of the envelope 106. Hence, two parts for transport 112 of working fluid 110 to the SSLs is provided in the horizontal position of the lamp 100.

The fixed wick material 108 is shaped as a dumbbell, i.e. illustrated by the H-shaped profile of the fixed wick material 108. The fixed wick material 108 is, moreover, arranged to be fixed in relation to the envelope 106 such that the shape of the fixed wick material 108 is substantially maintained when the lamp 100 is rotated. The formation of reservoirs of condensed working fluid not reaching the fixed wick material 108 is thereby mitigated.

Figure 2:
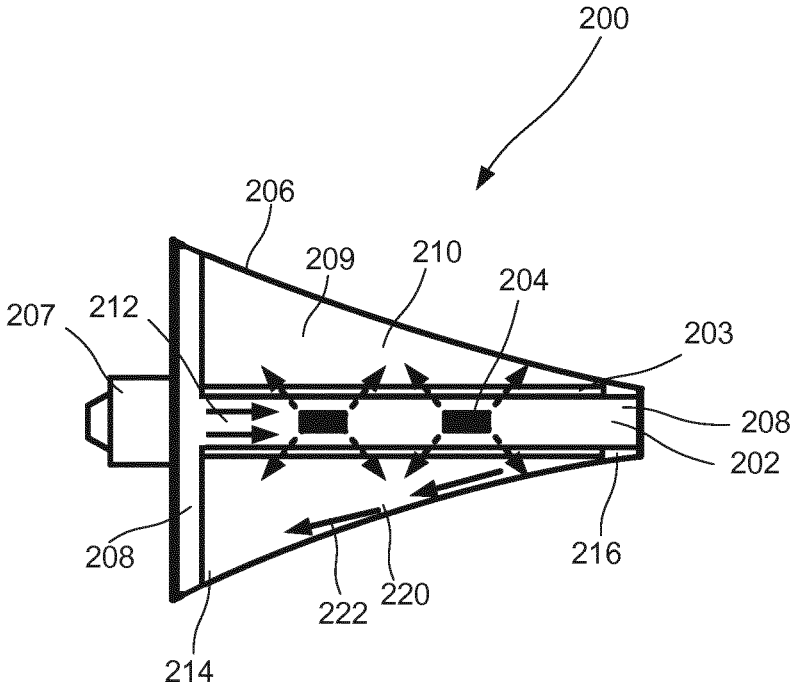
FIG. 2 illustrates a cross-sectional side view of a lamp according to another embodiment of the present inventions.

According to other embodiments the fixed wick material may be T-shaped or inversely T-shaped. To this end, FIG. 2 illustrates a cross-sectional side view of a lamp 200 comprising a tapered envelope 206. The envelope 206 has thereby a gradual diminution of thickness. The envelope 206 is further convex as seen from the inside of the lamp 200. The lamp 200 is oriented horizontally in FIG. 2, but may be used efficiently in any orientation in space. The lamp 200 further comprises a wick structure 202 comprising a fixed wick material 208, solid state light sources, SSLs, 204 and a base 207. The envelope 206 forms a cavity 209 as discussed in relation the cavity 109 of FIGS. 1*a*-1*c*. The cavity 209 is also configured as a heat pipe comprising a working fluid 210 as discussed above.

A portion of the wick structure 202 is formed by a first material 208 surrounded by a second material 203. The second material 203 may be a support 203. An improved rigidity of the fixed wick material 208 may thereby be provided such that the fixed wick material 208 of the wick structure 202 is arranged to be fixed in relation to the envelope 206, independent of the orientation of the lamp 200. It is realized that other embodiments of the lamp may as well comprise a wick structure comprising two or more fixed wick materials. For example, the lamp of FIGS. 1*a*-1*c* may comprise a wick structure comprising two or more fixed wick materials.

In the following, the heat pipe function of the lamp 200 will be described. Cooling of the SSLs 204 is achieved by efficiently transporting 212 of working fluid 210 to the SSLs 204 which are hosted in the fixed wick material 208. Working fluid 210 is further recycled efficiently such that continuous cooling of the SSLs 204 may be achieved. Working fluid 210 which is evaporated after being in thermal contact with the hot SSLs 204 may thereafter leave the fixed wick material 208 as indicated be the dashed arrows 218. The evaporated working fluid 210 may condensate 220 when reaching the surface of the envelope 206. Gravitational forces then transport the condensed working fluid 210 as indicated by the solid arrows 222 to the distal end 214 of the envelope 206. Working fluid 210 reaching the fixed wick material 208 at the distal end 214 of the envelope 106 may then be reabsorbed by the fixed wick material 208 such that working fluid 210 may recycled within the lamp 200.

It should be noted that that when the lamp 200 is operated in a base-down configuration (not shown) the condensed working fluid 210 will also predominately reach the fixed wick material 208 at the distal end 214. If, however, the lamp 200 is arranged in a base-up configuration (not shown) the condensed working fluid 210 will instead reach the fixed wick material 208 at the distal end 216. Hence, the shape of the envelop 206 allows for efficient transport of condensed working fluid 210 to the fixed wick material 208, independent on the orientation on space of the lamp 200. Efficient cooling of the SSLs 204 is thereby obtained. A more efficient lamp 200 is therefore provided.

The envelope may comprise transmissive glass, quartz, a transmissive ceramic, or a transmissive polymer. The term "transmissive" may especially refer to transparent or translucent, and refers to the transmissivity for (visible) light.

The material of the envelope may comprise one or more materials selected from the group consisting of a transmissive organic material support, such as selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethylene terephthalate (PET), (PETG) (glycol modified polyethylene terephthalate), PDMS (polydimethylsiloxane), and COC (cyclo olefin copolymer). However, in another embodiment the material of the envelope may comprise an inorganic material. Preferred inorganic materials are selected from the group consisting of glasses, (fused) quartz, transmissive ceramic materials, and silicones. Also hybrid materials, comprising both inorganic and organic parts may be applied. Especially preferred are PMMA, transparent PC, or glass as material for the material of the envelope.

The fixed wick material may be transmissive for visible light generated by the SSL. The fixed wick material may comprise particles, such as spherical particles, especially these (spherical) particles having dimensions, such as diameters, selected from the range of 1-150 μm, like 5-120 μm. The (spherical) particles may especially comprise a particle material transmissive for visible light generated by the SSL. For instance, glass particles or glass beads may be used, especially hollow particles or beads may be used. By choosing the right dimensions, such as the afore-mentioned diameters, a porous layer may be obtained. As is known to the person skilled in the art, the fixed wick material will be a porous layer, configured to allow transport of the fluid, such as a fluid in a liquid state. The working fluid may comprise one or more of H2O, methanol, ethanol, i-propanol (iso propanol), 1-propanol, butanol (such as 1-butanol), acetone, and (optionally) ammonia, etc. Especially, the working fluid comprises a fluid that has a boiling point selected from the range of −50-150° C. (at atmospheric pressure). Especially, the working fluid may comprise a fluid that has a boiling point at atmospheric pressure above the expected working temperature range of the heat pipe, especially boiling point in the range of 60-130° C.

The working fluid may be selected of one or more of ammonia, pentane, acetone, methanol, ethanol, propanol, heptane and water, especially one or more of water, ethanol and methanol, even more especially one or more of water and ethanol. In yet a further embodiment, the working fluid comprises one or more of H2O, methanol, ethanol, propanol (such as one or more of 1-propanol and i-propanol), butanol (such as one or more of 1-butanol, 2-butanol, etc.), acetone, pentane, heptane, and (optionally) ammonia.

The support may include a material that has a good thermal conductivity. For instance, the support may include a metal layer or ceramic layer. The person skilled in the art realizes that the present invention by no means is limited to the preferred embodiments described above. On the contrary, many modifications and variations are possible within the scope of the appended claims. For example, the envelope may be hourglass-shaped or saddle-shaped such that such that condensed working fluid is guided towards the fixed wick material independently of the spatial orientation of the lamp.

The SSL may be arranged in liquid contact with the fixed wick material of the wick structure.

The SSL may be arranged inside, outside, or adjacent to the fixed wick material.

It should be noted that the wick structure may comprise a fixed wick material and a support. The fixed wick material may, for example, be formed as a layer on a portion of the support.

The SSL may be physically separated from the cavity.

It should be noted that the SSL may be arranged inside or at the surface of the fixed wick material. Efficient heat transport between the fixed wick material and the solid light source may thereby be provided.

The wick structure may further comprise a second cavity in which the SSLs are arranged such that the SSLs are physically separated from the fixed wick material, but in thermal contact to the fixed wick material. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lamp comprising:

a wick structure having a solid state light source hosted thereon, the wick structure comprising a fixed wick material, an envelope having a cavity to host the wick structure, wherein the cavity is configured as a heat pipe comprising a working fluid, wherein the envelope is convex shaped as seen from an inside of the lamp such that condensed working fluid is guided towards the fixed wick material independently of the spatial orientation of the lamp.

2. The lamp according to claim 1, wherein the envelope is hourglass-shaped.

3. The lamp according to claim 1, wherein the fixed wick material is dumbbell-shaped.

4. The lamp according to claim 1, wherein the wick structure further comprises a support.

5. The lamp according to claim 1, wherein the fixed wick material is adapted to transporter working fluid to the solid state light source, at least upon the solid state light source is in an active state emitting light.

6. The lamp according to claim 1, wherein the fixed wick material is hosting the solid state light source.

7. The lamp according to claim 1, wherein at least a portion of the wick structure is formed by a first material surrounded by a second material.

* * * * *